US005337789A

United States Patent [19]

Cook

[11] Patent Number: 5,337,789

[45] Date of Patent: Aug. 16, 1994

[54] VORTEX VALVES

[75] Inventor: Roger J. Cook, Berkeley, United Kingdom

[73] Assignee: Hydro International Limited, United Kingdom

[21] Appl. No.: 50,026

[22] PCT Filed: Oct. 29, 1991

[86] PCT No.: PCT/GB91/01889

§ 371 Date: Apr. 28, 1993

§ 102(e) Date: Apr. 28, 1993

[87] PCT Pub. No.: WO92/08059

PCT Pub. Date: May 14, 1992

[30] Foreign Application Priority Data

Oct. 29, 1990 [GB] United Kingdom ..... 9023471

[51] Int. Cl.[5] ..... F15C 1/16

[52] U.S. Cl. ..... 137/812; 137/810; 137/833

[58] Field of Search ..... 137/810, 812, 833

[56] References Cited

U.S. PATENT DOCUMENTS

| | | | |
|---|---|---|---|
| 3,195,303 | 7/1965 | Widell . | |
| 3,215,165 | 11/1965 | Boadway . | |
| 3,219,048 | 11/1965 | Palmisano . | |
| 3,513,865 | 5/1970 | Van Der Heyden . | |
| 3,521,657 | 7/1970 | Ayers . | |
| 3,638,672 | 2/1972 | Smith et al. . | |
| 3,712,321 | 1/1973 | Bauer | 137/812 |
| 3,722,522 | 3/1973 | Randall . | |
| 4,206,783 | 6/1980 | Brombach . | |
| 4,846,224 | 7/1989 | Collins, Jr. et al. | 137/810 |
| 4,889,166 | 12/1989 | Lakatos | 137/810 |
| 5,080,137 | 1/1992 | Adams | 137/810 |

FOREIGN PATENT DOCUMENTS

| | | |
|---|---|---|
| 0312271 | 4/1989 | European Pat. Off. . |
| 2431112 | 1/1976 | Fed. Rep. of Germany . |
| 2658619 | 6/1978 | Fed. Rep. of Germany . |
| 2365713 | 4/1978 | France . |
| 8500446 | 1/1985 | PCT Int'l Appl. . |
| 1053302 | 12/1966 | United Kingdom . |
| 1125931 | 9/1968 | United Kingdom . |
| 1256903 | 12/1971 | United Kingdom . |
| 1526957 | 10/1974 | United Kingdom . |
| 2141561 | 12/1984 | United Kingdom . |

OTHER PUBLICATIONS

Brombach, Dr. H., "More than 500 vortex flow regulators and vortex valves in Use", *Das Gas und Wasserfach*, Munich, Germany, 123(1982) H.3, pp. 166–167.

*Primary Examiner*—A. Michael Chambers

*Attorney, Agent, or Firm*—Larson and Taylor

[57] ABSTRACT

A vortex valve includes a housing having a cylindrical side wall and opposite ends to define a vortex chamber. The sidewall of the housing has a primary tangential inlet through which liquid may enter the vortex chamber in a manner to promote swirl within the vortex chamber and an outlet at one axial end of the vortex chamber. The outlet represents at least 50% of the area of the end of the vortex chamber in which it is situated and in the vortex chamber has a length which is at least one and a half times the diameter of the outlet. The vortex valve requires only a low head to initiate vortex flow.

16 Claims, 2 Drawing Sheets

VORTEX VALVES

FIELD OF THE INVENTION

This invention relates to vortex valve flow controls and is more particularly concerned with a vortex valve having a vortex chamber which is an elongate circular cylinder.

BACKGROUND ART

A vortex valve is a device for controlling fluid flow by a hydraulic effect without requiring moving parts. Such devices have a vortex chamber provided with an outlet at one axial end and an inlet arranged to cause swirl in the chamber when a certain critical flow has been attained. In use, the inlet communicates with a body of water which exerts a pressure head on the liquid entering the vortex chamber. Air is entrained in the liquid drawn through the valve so that, when vortex flow has been established, a central air core exists. U.S. Pat. No. 4,206,783 discloses a vortex valve having a conical vortex chamber with a tangential inlet and an outlet disposed at the narrower end of the chamber. Also known are short vortex valves of which the cross-sectional configuration of the vortex chamber is a logarithmic spiral extending the full length of its longitudinal axis to the outlet. At low flow rates, water entering through the inlet of a vortex valve passes through the vortex chamber to the outlet with substantially no pressure drop and the valve can be considered to be open. However, at high flow rates, water enters through the inlet with enough energy to create a vortex in the vortex chamber which results in a considerable pressure drop between the inlet and the outlet and may greatly restrict flow through the outlet, or even substantially cut it off altogether. Thus the valve serves to limit the rate of flow through it automatically. Vortex valves can be used, for example, to control the flow of storm water in sewers, to ensure that equipment downstream of the valve is not overloaded during periods of heavy rainfall.

DE-A-2658619 discloses a valve for regulating the flow of a liquid or gaseous medium whilst minimizing noise which would be caused by turbulent flow. It is stated that this is achieved by avoiding free boundary surfaces of the flow medium current which emerges from the regulating opening. This contrasts with a vortex valve in which a key element is the establishment of a free boundary surface between the flow medium and the air core, which is an essential feature of a vortex flow control. This feature would be expected to generate noise.

The flow characteristics of a vortex valve flow control (once a vortex has been initiated in the vortex chamber thereof) are dependent on a number of factors including the area of the outlet (A) and the head (H) of fluid upstream of the device. A reasonable approximation of the relationship between the flow (Q) through a vortex valve flow control and the area of the outlet (A) and head (H) is given by the equation:

$$Q = C_d A\,(2gH)$$

where $C_d$ is a coefficient of discharge which is dependent upon the type of vortex valve under consideration, and g is the gravity constant.

Before initiation of the vortex, the rate of flow of fluid through the device is directly dependent upon the head (H) and the area (A) of the outlet. In the "pre-initiation" zone (i.e shortly before initiation), the flow actually decreases somewhat for a small increase in head, before increasing again at initiation at a slower rate than before. This gives rise to what is termed a "pre-initiation bulge" during which the characteristics of the vortex valve are such that it permits a higher rate of flow for a given pressure head than one would expect from a direct extrapolation back towards the origin of the curve at high heads after initiation. In some circumstances, it is desirable to reduce or even eliminate the pre-initiation bulge.

The configuration of a vortex valve determines its flow characteristics, namely its coefficient of discharge ($C_d$), the extent of pre-initiation bulge and the head required to initiate the vortex.

In some circumstances, it is desirable to control high rates of flow under low head conditions, for instance on river controls or irrigation schemes. At present, this is achieved by the use of orifice flow controls and venturi flumes but these both suffer from disadvantages. To meet such requirements in a vortex valve and for a given outlet area, the $C_d$ should be relatively high and it should also be the case that vortex flow in the vortex valve is initiated at relatively low flows.

It would therefore be desirable to provide a vortex valve having a relatively high $C_d$ and requiring a relatively low head to initiate vortex flow in the vortex valve. This has surprisingly been achieved in accordance with the present invention by the use of a vortex valve having a vortex chamber which is an elongate circular cylinder.

SUMMARY

Thus, according to a first aspect of the present invention, there is provided a vortex valve comprising a housing defining a vortex chamber, the housing having an inlet through which liquid may enter the vortex chamber in a manner to promote swirl within the vortex chamber and an outlet at one axial end of the vortex chamber, characterised in that the outlet represents at least 50% of the area of the end of the vortex chamber in which it is situated and in that the vortex chamber has a length which is at least one and a half times the diameter of the outlet.

It is surprising that vortex flow in a vortex valve having a vortex chamber which is an elongate circular cylinder initiated at low heads. It would normally be expected that initiation of vortex in a circular cylinder would require a very high head.

The vortex valve of the present invention may be used to control the flow of liquid through a liquid barrier such as a barrier across a river or other body of flowing water where the pressure head available is relatively low. In such an arrangement, the outlet of the vortex valve is connected to an opening in the liquid barrier on the upstream side of the liquid barrier. Thus, according to a second aspect of the present invention, there is provided a liquid barrier interposed across the flow of a body of liquid, said liquid barrier having an opening for passage of liquid across the barrier, wherein, on the upstream side of the barrier, there is situated a vortex valve in accordance with the first aspect of this invention, the outlet of which communicates with said opening in the barrier. The liquid barrier of this aspect of the invention may be a wall of a drainage basin or gully (or any liquid collection region or interceptor through which liquid may flow), which wall is provided with an outlet for drainage of waste liquid from the basin. In such an arrangement, the inlet (or a pipeline connected to the inlet) of the vortex valve will communicate with (i.e. open into) the body of liquid (usually water) on the upstream side of the liquid barrier.

The vortex valve of the present invention may also be used in an irrigation scheme to control the flow of liquid from the primary water channel to subsidiary irrigation channels. Thus, according to a third aspect of this invention, there is provided an irrigation system comprising a primary water channel and a secondary irrigation channel, wherein, at the junction between the primary channel and the secondary irrigation channel, there is situated a vortex valve in accordance with the first aspect of this invention, the vortex valve being arranged with its outlet opening into the secondary irrigation channel to control liquid flow from the primary channel to the secondary irrigation channel. Typically, there will be a plurality of secondary irrigation channels each leading from the primary channel. A vortex valve in accordance with this invention may be used to control the liquid flow to each irrigation channel.

The outlet of the vortex valve of the present invention should open directly out of the vortex chamber, is circular in cross-section and has an area which represents at least 50% of the area of the end of the vortex chamber in which it is situated. More preferably, the opening represents at least 80% of the area of the end of the vortex chamber. Most preferably, the outlet end of the vortex chamber is fully open.

The length of the vortex chamber is at least one and a half times the diameter of the outlet opening. Preferably, the length should be about twice the diameter of the outlet opening.

The constraints on the area of the outlet and the length of the vortex chamber mean that the over all length of the chamber will be greater than the diameter of the chamber.

The inlet or mouth to the vortex chamber is preferably tangential and will normally represent at least 30%, more preferably at least 50% of the length of the vortex chamber. Most preferably, the inlet to the vortex chamber extends substantially the full length of the vortex chamber. The height (or width) of the mouth may be from as low as 10%, up to 89% of the radius of the vortex chamber. More preferably, the height of the mouth is at least 20% of the radius of the vortex chamber.

The vortex valves of the present invention can be constructed to have coefficients of discharge of 0.4 and above. This enables high rates of flow to be achieved with low pressure heads. Moreover, vortex flow in the vortex valves described herein is initiated at relatively low pressure heads and this makes them especially suitable for use on river controls or irrigation schemes. For instance, it has been found that heads as little as one times the diameter of the vortex chamber can give rise to initiation. The cylindrical flow controls of this invention may be controlled accurately and avoid the problem encountered with conventional flow controls of high velocity shooting flow. Moreover, because the inlet and outlet of the vortex valve are relatively large, there is a reduction in the risk of blockage. The vortex valves described herein are also advantageous as they are cheap to install and maintain; they also offer an improvement in performance where downstream water levels in a river would otherwise affect the performance of a flume.

BRIEF DESCRIPTION OF THE DRAWINGS

For a better understanding of the present invention, and to show how the same may be carried into effect, reference will now be made, by way of example, to the accompanying drawings in which.

DETAILED DESCRIPTION OF THE PREFERRED EMBODIMENT

Figure 1:
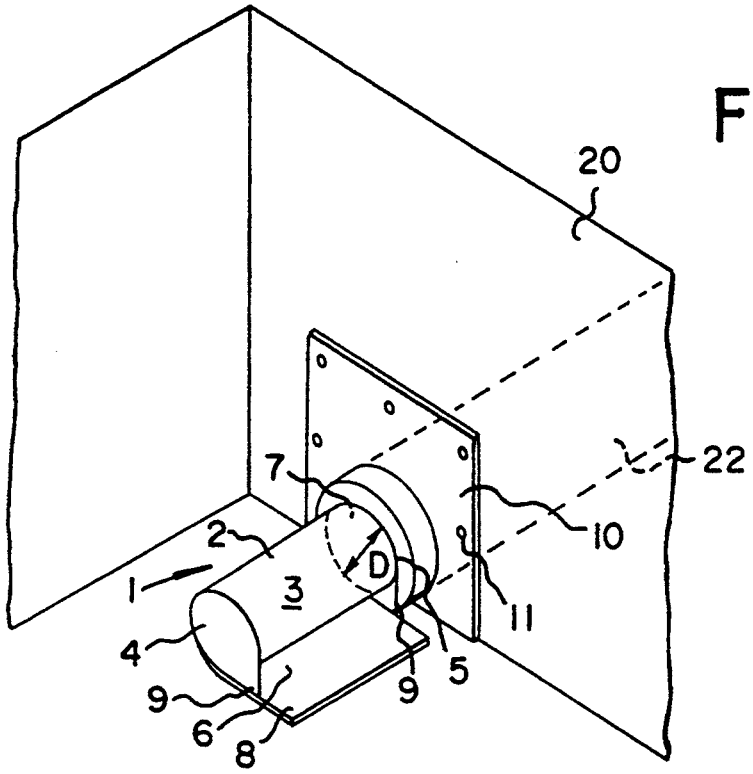
FIG. 1 is a perspective view of a vortex valve in accordance with the present invention in use on a liquid barrier.

FIG. 1 illustrates a vortex valve 1 in use on a river barrier 20 having an outlet passage 22. The vortex valve 1 comprises a housing 2 which defines a vortex chamber 3. The housing 2 has first and second ends 4, 5, end 4 being closed. An inlet or mouth 6 is provided along the length of the housing 2 and communicating with the vortex chamber 3. Also provided is a generally circular outlet 7 of diameter D in the second end 5.

In order to direct flow toward the mouth 6 of the vortex chamber 3, a flow plate 8 is provided which is fixed to the housing 2 and made secure by webs 9 which project from each end 4, 5. The vortex valve 1 also includes a mounting plate 10 having mounting holes 11 by which the vortex valve may be mounted in position adjacent the outlet passage 22 in the liquid barrier 20 whereby the outlet 7 of the vortex chamber 3 communicates with the outlet passage 22 in the liquid barrier 20. This enables the flow through the liquid barrier 20 to be regulated by the vortex valve 1.

The vortex valve 1 functions in a manner known per se. Accordingly, liquid enters the vortex chamber 3 via the narrow mouth 6. When the head of liquid upstream of the vortex chamber is very low, liquid will flow straight through the vortex chamber and out of the opening 7. However, when the head is sufficiently high (normally at least one times the diameter of the vortex valve) vortex flow is initiated in the vortex chamber 3 by virtue of the mouth being arranged to direct flow tangentially into the vortex chamber 3. It has been surprisingly found that, with vortex chambers of the present invention which have an elongate circular cylindrical configuration, initiation occurs at relatively low pressure heads.

Figure 2:
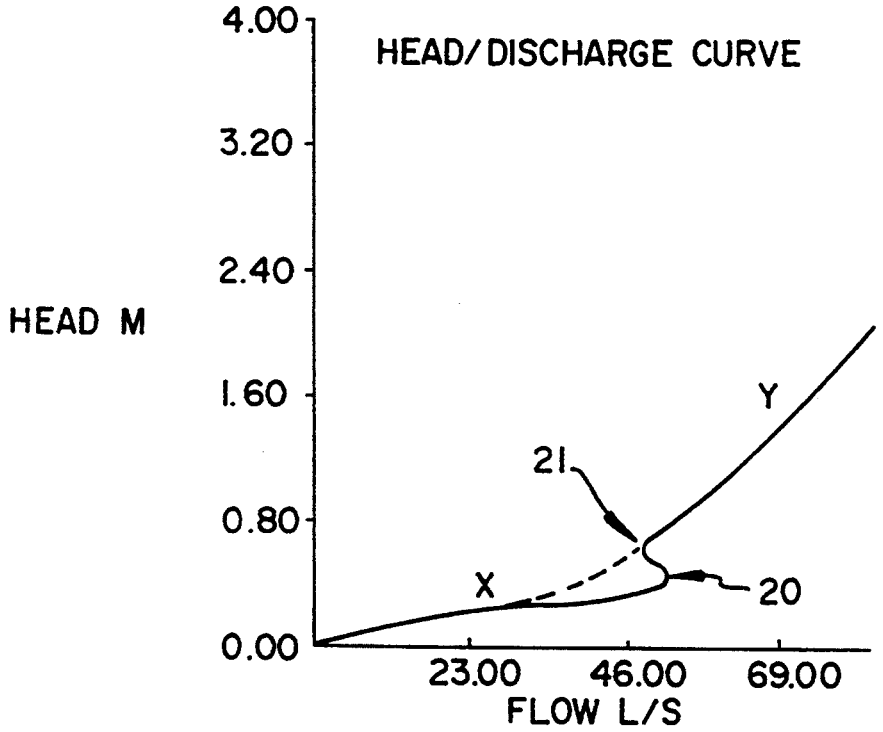
FIG. 2 is a graph showing the flow characteristics of a prior art vortex valve having a conical vortex chamber.
Figure 3:
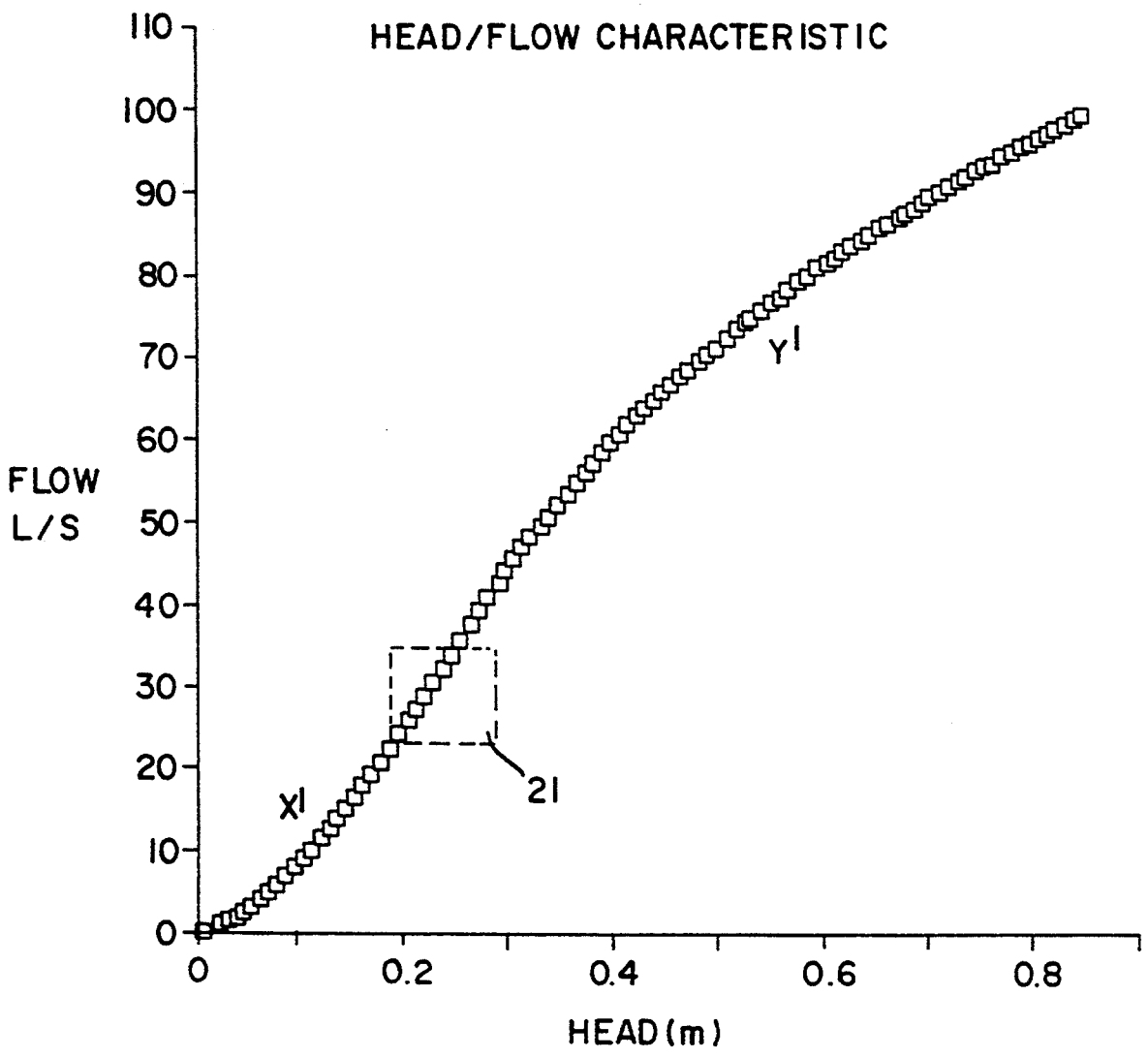
FIG. 3 is a graph showing the flow characteristics of a vortex valve in accordance with the present invention.

FIG. 2 and 3 illustrate the flow characteristics of a prior art vortex valve having a conical vortex chamber (FIG. 2) and a vortex valve in accordance with the present invention in which the vortex chamber is an elongate circular cylinder (FIG. 3). Although the two graphs are not drawn to the same scale, it can be seen that the vortex valve of the present invention (FIG. 3) initiates with no significant "preinitiation bulge" in contrast with FIG. 2 which shows a relatively large preinitiation bulge 20. Both graphs illustrate the change in the rate of flow from a relatively rapid increase in the rate of flow for a given pressure head increase (X) to a relatively slow increase in flow for a relatively high pressure head (Y) following initiation at an initiation point 21. Although not shown in FIG. 3, the pressure head required in order to initiate a vortex in the vortex chamber 3 of the vortex valve in accordance with the present invention is relatively low (as low as one times the diameter of the vortex valve itself) in contrast with prior art devices in which the head normally must be at least 3 or 4 times the diameter of the vortex valve in order to give initiation.

I claim:

1. A vortex valve comprising a housing having a cylindrical side wall and opposite ends to define a cylindrical vortex chamber which has a length l between said ends, said side wall of the housing having a primary, tangential inlet through which liquid may enter the vortex chamber in a manner to promote swirl within the vortex chamber and an outlet of diameter D at one axial end of the vortex chamber, wherein said outlet represents at least 50% of the area of the end of the vortex chamber in which it is situated and length l of said vortex chamber is at least one and a half times the diameter D of the outlet.

2. A vortex valve according to claim 1, wherein the outlet of the vortex valve is circular in cross-sectional.

3. A vortex valve according to claim 1, wherein the area of the outlet represents at least 80% of the area of the end of the vortex chamber in which it is situated.

4. A vortex valve according to claim 1, wherein the outlet end of the vortex chamber is fully open.

5. A vortex valve according to claim 1, wherein the inlet extends along at least 30% of the length of the vortex chamber.

6. A vortex valve according to claim 1, wherein the inlet extends along at least 50% of the length of the vortex chamber.

7. A vortex valve according to claim 1, wherein the inlet to the vortex chamber extends substantially the full length of the vortex chamber.

8. A liquid barrier interposed across the flow of a body of liquid, said liquid barrier having an opening for passage of liquid across the barrier, wherein, on the upstream side of the barrier, there is situated a vortex valve as claimed in claim 1, the outlet of which communicates with said opening in the barrier and the inlet communicating with the body of water.

9. A liquid barrier according to claim 8, wherein the liquid barrier is a wall of a drainage basin and the inlet of the vortex valve communicates with the body of liquid on the upstream side of the barrier.

10. An irrigation system comprising a primary water channel and a secondary irrigation channel, wherein, at the junction between the primary channel and the secondary irrigation channel, there is situated a vortex valve as claimed in claim 1, said vortex valve being arranged with its outlet opening into the second irrigation channel to control liquid flow from the primary channel to the secondary irrigation channel.

11. An irrigation system according to claim 10, in which there are a plurality of secondary irrigation channels each leading from the primary channel, there being a vortex valve as claimed in claim 1 situated at the junction between the primary channel and each secondary irrigation channel.

12. A vortex valve comprising a housing having a cylindrical side wall and opposite ends to define a cylindrical vortex chamber which is free from internal fittings and which has a length l between said ends, said side wall of said housing having a primary, tangential inlet which extends substantially the full length l of said vortex chamber through which liquid may enter said vortex chamber in a manner to promote swirl within said vortex chamber, and an outlet of diameter D at one axial end of said vortex chamber, said housing being free from any secondary, control inlet; wherein the outlet represents at least 80% of the area of the end of the vortex chamber in which it is situated, and wherein length l of the vortex chamber is at least one and a half times the diameter D of the outlet.

13. An irrigation system comprising a primary water channel and a secondary irrigation channel, wherein, at the junction between the primary channel and the secondary irrigation channel, there is situated a vortex valve as claimed in claim 14, said vortex valve being arranged with its outlet opening into the second irrigation channel to control liquid flow from the primary channel to the secondary irrigation channel.

14. An irrigation system according to claim 13, in which there are a plurality of secondary irrigation channels each leading from the primary channel, there being a vortex valve as claimed in claim 14 situated at the junction between the primary channel and each secondary irrigation channel.

15. A liquid barrier interposed across the flow of a body of liquid, said liquid barrier having an opening for passage of liquid across the barrier, wherein, on the upstream side of the barrier, there is situated a vortex valve as claimed in claim 14, the outlet of which communicates with said opening in the barrier and the inlet communicating with the body of water.

16. A liquid barrier according to claim 15, wherein the liquid barrier is a wall of a drainage basin and the inlet of the vortex valve communicates with the body of liquid on the upstream side of the barrier.

* * * * *